US007347335B2

(12) United States Patent
Rankin, VI et al.

(10) Patent No.: US 7,347,335 B2
(45) Date of Patent: Mar. 25, 2008

(54) PUSHER ASSEMBLY, MERCHANDISE DISPENSER AND METHOD OF DISPENSING MERCHANDISE

(75) Inventors: Alexander Rankin, VI, Dresher, PA (US); Robert Gustafson, Collegeville, PA (US)

(73) Assignee: Vulcan Spring & Manufacturing Company, Telford, PA (US)

( * ) Notice: Subject to any disclaimer, the term of this patent is extended or adjusted under 35 U.S.C. 154(b) by 556 days.

(21) Appl. No.: 11/040,361

(22) Filed: Jan. 21, 2005

(65) Prior Publication Data

US 2006/0163180 A1 Jul. 27, 2006

(51) Int. Cl.
*A47F 1/04* (2006.01)

(52) U.S. Cl. ..... 211/59.3; 312/61

(58) Field of Classification Search ..... 211/51, 211/59.3, 121, 122, 1.57; 312/61, 71; 221/226, 221/227, 270, 271, 279; 248/575, 578, 579
See application file for complete search history.

(56) References Cited

U.S. PATENT DOCUMENTS

| | | | | | |
|---|---|---|---|---|---|
| 3,342,536 | A | | 9/1967 | Cohen | 312/71 |
| 3,357,760 | A | | 12/1967 | Shelley et al. | 312/71 |
| 3,376,085 | A | | 4/1968 | McPherson | 312/71 |
| 3,567,293 | A | | 3/1971 | Salcman | 312/71 |
| 4,303,162 | A | | 12/1981 | Suttles | 211/49 D |
| 4,351,439 | A | | 9/1982 | Taylor | 211/49 D |
| 4,729,481 | A | | 3/1988 | Hawkinson et al. | 211/59.3 |
| 4,953,748 | A | * | 9/1990 | Wheelock | 221/59 |
| 5,012,936 | A | | 5/1991 | Crum | 211/59.3 |
| 5,131,563 | A | | 7/1992 | Yablans | 221/92 |
| 5,190,186 | A | | 3/1993 | Yablans et al. | 221/124 |
| 5,562,217 | A | | 10/1996 | Salveson et al. | 211/59.3 |
| 5,605,237 | A | * | 2/1997 | Richardson et al. | 211/59.3 |
| 5,634,564 | A | | 6/1997 | Spamer et al. | 211/59.3 |
| 5,665,304 | A | | 9/1997 | Heinen et al. | 312/71 |
| 5,878,895 | A | | 3/1999 | Springs | 211/59.3 |
| 6,109,458 | A | * | 8/2000 | Walsh et al. | 211/59.3 |
| 6,142,317 | A | * | 11/2000 | Merl | 211/59.3 |
| 6,158,598 | A | * | 12/2000 | Josefsson | 211/54.1 |
| 6,253,954 | B1 | * | 7/2001 | Yasaka | 221/93 |
| 6,381,966 | B1 | * | 5/2002 | Barrow | 62/3.61 |
| 6,464,089 | B1 | * | 10/2002 | Rankin, VI | 211/59.3 |
| 6,484,891 | B2 | * | 11/2002 | Burke | 211/59.3 |
| 6,515,590 | B1 | * | 2/2003 | Lauria | 340/692 |
| 6,523,703 | B1 | * | 2/2003 | Robertson | 211/59.3 |
| 6,616,140 | B2 | * | 9/2003 | Siegenthaler | 271/213 |
| 6,691,891 | B2 | * | 2/2004 | Maldonado | 221/279 |
| 6,820,754 | B2 | * | 11/2004 | Ondrasik | 211/59.3 |

(Continued)

FOREIGN PATENT DOCUMENTS

GB 2 297 241 A 7/1996

*Primary Examiner*—Jennifer E. Novosad
(74) *Attorney, Agent, or Firm*—Howson & Howson LLP

(57) ABSTRACT

A spring-driven pusher assembly of a merchandise dispenser in which the spring is carried entirely on the pusher assembly behind the articles being dispensed to thereby eliminate any interference problems with RF signals or the like used for purposes of determining inventories and the like. Preferably, the spring is a spiral spring that rotates a drive wheel when the spring uncoils. The drive wheel cooperatively engages a guide track on the base of the dispenser, and the rotation of the drive wheel causes the pusher assembly to advance along the guide track toward the dispensing end of the dispenser.

18 Claims, 4 Drawing Sheets

U.S. PATENT DOCUMENTS 7,293,663 B2 * 11/2007 Lavery, Jr. ..... 211/59.3
2004/0099620 A1 * 5/2004 Robertson et al. ..... 211/59.3
2005/0077259 A1 * 4/2005 Menz ..... 211/59.3
2006/0163272 A1 * 7/2006 Gamble ..... 221/227
2006/0237381 A1 * 10/2006 Lockwood et al. ..... 211/59.3

* cited by examiner 10
30
30
28
38
14
18
16
42
3
3
62
40
46
28
34
22
12
20
36
26

PUSHER ASSEMBLY, MERCHANDISE DISPENSER AND METHOD OF DISPENSING MERCHANDISE

BACKGROUND OF THE INVENTION

The present invention relates to a spring-driven pusher for use in a merchandise dispenser to automatically feed merchandise to a dispensing end of the dispenser. The present invention also relates to a merchandise dispenser utilizing the pusher assembly and to a method of dispensing merchandise.

An example of a merchandise dispenser having a spring-driven pusher is disclosed by U.S. Pat. No. 6,464,089 B1 issued to Rankin, VI and assigned to Vulcan Spring & Manufacturing Company, the assignee of the present application. Other examples of merchandisers are provided by U.S. Pat. No. 4,303,162 issued to Suttles; U.S. Pat. No. 5,634,564 issued to Spamer et al.; U.S. Pat. No. 5,012,936 issued to Crum; U.S. Pat. No. 5,562,217 issued to Salveson et al.; U.S. Pat. No. 5,878,895 issued to Springs; U.S. Pat. No. 5,131,563 issued to Yablans; U.S. Pat. No. 5,190,186 issued to Yablans et al.; U.S. Pat. No. 3,342,536 issued to Cohen; U.S. Pat. No. 4,351,439 issued to Taylor; U.S. Pat. No. 4,729,481 issued to Hawkinson et al.; and U.S. Pat. No. 5,665,304 issued to Heinen et al. and by UK Patent Application No. GB 2297241A.

Such dispensers are typically utilized in retail stores, outlet stores and the like to store and display products and to permit products to be removed therefrom. The dispensers are typically provided with a forward feeding pusher so that a stacked row of identical products located in front of the pusher is biased toward the front dispensing end of the dispenser. Thus, when one of the products from the front end is removed, the products remaining in the row are pushed forward. Such a pusher typically projects from a track located below the products. However, it can also depend from a track located above the products or extend laterally from a track extending adjacent the sides of the products. Yet another alternative is for the pusher to extend from a substantially vertical track and be utilized to up-feed or down-feed a stacked column of products.

Various hand-held electronic devices can be used to track inventory, set pricing information, or perform other functions with respect to merchandise stored in dispensers. For example, such a device may utilize radio frequency energy, signals or the like to read and/or write to electronic identification tags on the products or at the front of a display. Metal articles, such as metal springs in the dispensers, can interfere with the proper functioning of such devices.

Thus, although the above referenced merchandiser assemblies may be satisfactory for their intended purposes, there is a need for a spring-driven pusher device and dispenser that eliminates any possible interference with radio frequency and like signals. Preferably, the pusher should permit ready adjustment of the pushing force so that the same pusher device and spring can be utilized regardless of the shape, weight, surface texture, or size of the stored and displayed product. Further, the pushing force should be capable of precise and fine adjustment so that the pusher can be set to provide a proper amount of pushing force specifically required for the selected product. In addition, the pusher assembly and dispenser should be inexpensive to manufacture, easy to assemble and operate, and require only a minimum of effort and skill to adjust.

SUMMARY OF THE INVENTION

More specifically, the present invention provides a pusher assembly that is movable along a path of travel on a merchandise dispenser. The assembly includes a spring for exerting a force that resiliently urges a pusher in a dispensing direction on the dispenser. The spring is entirely contained within, and carried by, the pusher assembly for movement therewith. Preferably, the spring is a spiral spring having multiple coplanar windings, and the assembly includes a drive wheel that rotates and moves the assembly forward via the force exerted by the spring.

According to another aspect of the present invention, a merchandise dispenser is provided having the above referenced pusher assembly. The dispenser includes a base unit having a front dispensing end and an opposite end with the pusher assembly being movable along a path of travel between the opposed ends. A guide track cooperatively engages the pusher assembly and defines the path of travel of the pusher assembly on the base unit. Preferably, the guide track engages the drive wheel of the pusher assembly so that rotational movement of the drive wheel results in forward movement of the pusher assembly on the base unit.

According to yet another aspect of the present invention, a method of dispensing merchandise is provided. A series of articles are positioned in a merchandise dispenser ahead of a pusher assembly which urges the articles along a path of travel to a dispensing end of the dispenser. The method includes adjusting the tension of a spring on the pusher assembly to set a desired amount of pushing force exerted by the pusher assembly. The spring is contained entirely within the pusher assembly for movement therewith along the path of travel. Preferably, the method includes engaging a drive wheel of the pusher assembly with a guide track on the dispenser so that, when the spring unwinds, the drive wheel rotates resulting in forward movement of the pusher assembly along the guide track.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE INVENTION

Figure 1:
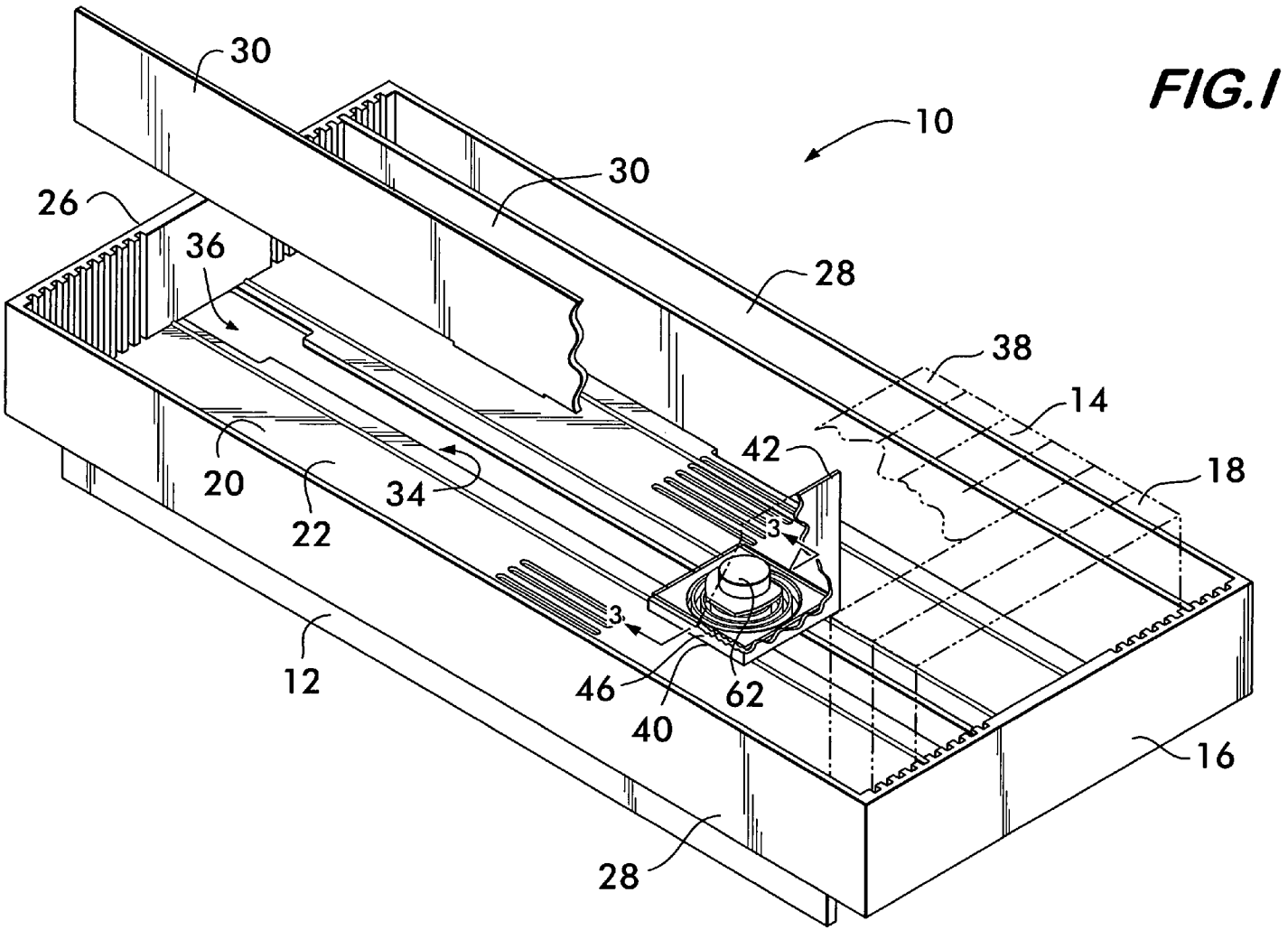
FIG. 1 is a perspective view of a merchandise dispenser having a pusher assembly according to the present invention.

As best illustrated in FIG. 1, a merchandise dispenser 10 according to the present invention includes a base unit 12 and a pusher assembly 40 for automatically feeding merchandise 14 (shown in phantom lines) stored and displayed in the dispenser 10 toward a dispensing end 16 of the base unit 12. In the illustrated embodiment, the base unit 12 extends under the merchandise 14 and supports the merchandise 14 thereon, and pusher assembly 40 feeds the merchandise 14 to a front end 16 of the base unit. Although not illustrated, the merchandise dispenser 10 can also be arranged to provide an up-feeding, down-feeding, side-feeding or top-feeding dispenser.

The merchandise 14 can be, for instance, individual boxes, bags, containers, cartons or the like containing a food or other product positioned in a single file row one behind the other within the dispenser 10. The leading box 18 is located at the front dispensing end 16 of the base unit 12, and upon removal by a customer or the like, the pusher assembly 40 urges the remaining boxes 14 forward to provide a new leading box adjacent the front dispensing end 16.

The base unit 12 can include a base panel 20 having a merchandise supporting surface 22 and an underside 24 extending between the front dispensing end 16 and an opposite end 26. As stated above, alternate arrangements can be utilized in which the base panel 20 extends above the merchandise or laterally of the merchandise. In the illustrated embodiment, base unit 12 also includes non-adjustable sidewalls 28 as well as adjustable sidewalls 30. The adjustable sidewalls 30 can be positioned at various spaced-apart locations on the base panel 20 to permit the base unit 12 to be used with merchandise of a variety of sizes. Thus, regardless of the size of the merchandise, the adjustable sidewalls 30 can be positioned to restrict lateral movement of the merchandise 14 relative to the intended path of travel toward the dispensing end 16.

The base unit 12 according to the present invention has a guide track, or rail, 32 in cooperative engagement with the pusher assembly 40. In the illustrated embodiment, the guide track 32 is secured to the underside 24 of the base panel 20 adjacent a centrally-extending elongate open slot 34. The pusher assembly 40 rides and is captured within slot 34 and includes means for engaging the guide track 32 underneath the base panel 20. Preferably, the slot 34 includes a widened portion 36 at end 26 of panel 20 to enable installation of the pusher assembly 40 on the base unit 12 and/or removal of the pusher assembly 40 from the base unit 12.

Figure 3:
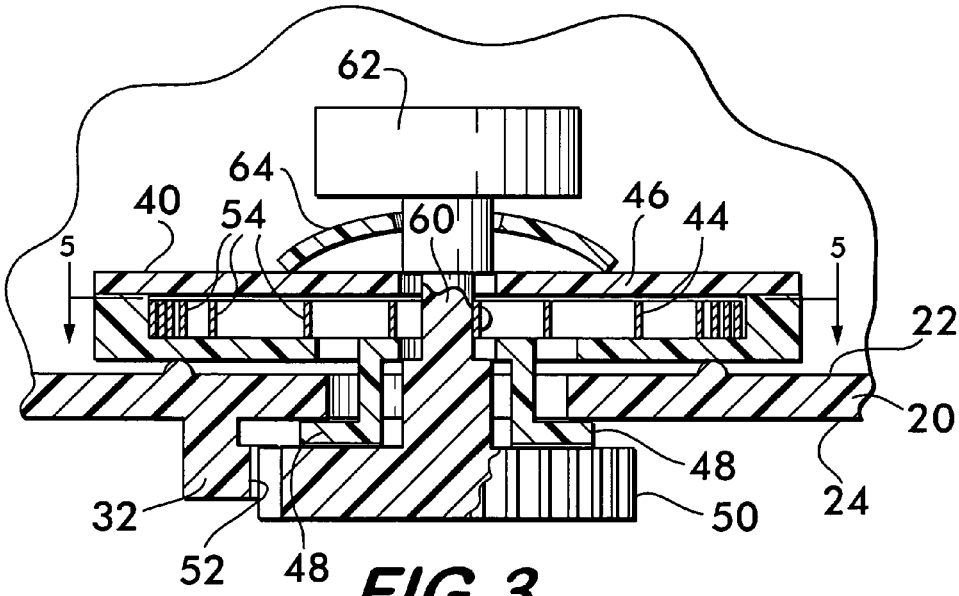
FIG. 3 is a cross-sectional view of the pusher assembly illustrated in FIG. 1 along line 3-3 in which the pusher assembly is in a position engaged with the guide track.
Figure 4:
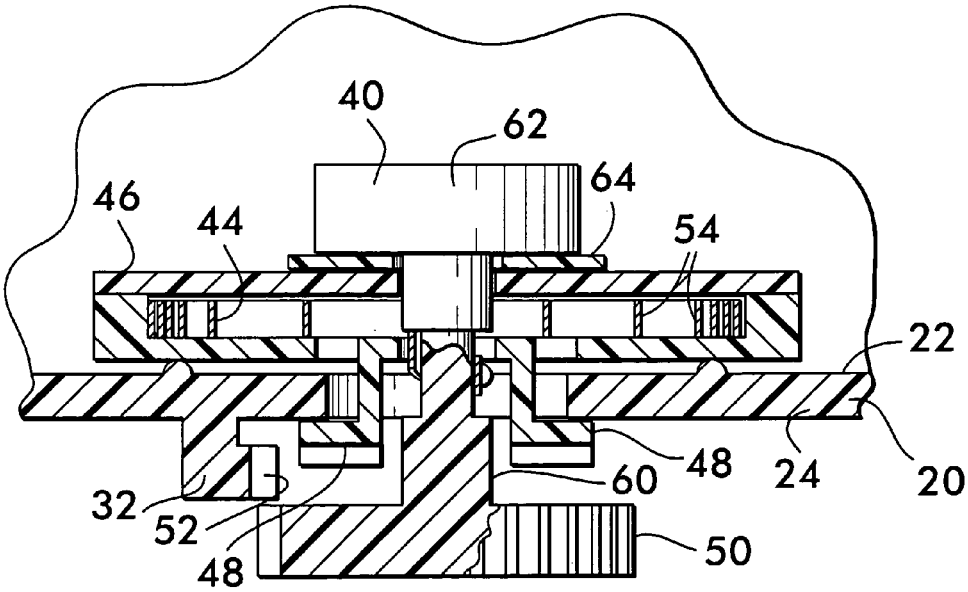
FIG. 4 is a cross-sectional view of the pusher assembly in a position disengaged from the guide track.

The pusher assembly 40 includes a pusher 42 projecting from the base panel 20 to a position for engaging a rearward most item 38 of the single file row of merchandise 14 within the dispenser 10. A spring 44 is contained entirely within a housing 46 that extends rearwardly (relative to the dispensing direction of the dispenser 10) from the pusher 42 and that is carried by and moves with the pusher assembly 40. A pair of flanges 48 depend from the housing 46 and capture the edges of the base panel 20 that form the open slot 34. This is best illustrated in FIGS. 3 and 4. Thus, the pusher assembly 40 is located behind the row of merchandise 14, is captured within the slot 34, and is movable along a path of travel defined by the slot 34.

Figure 2:
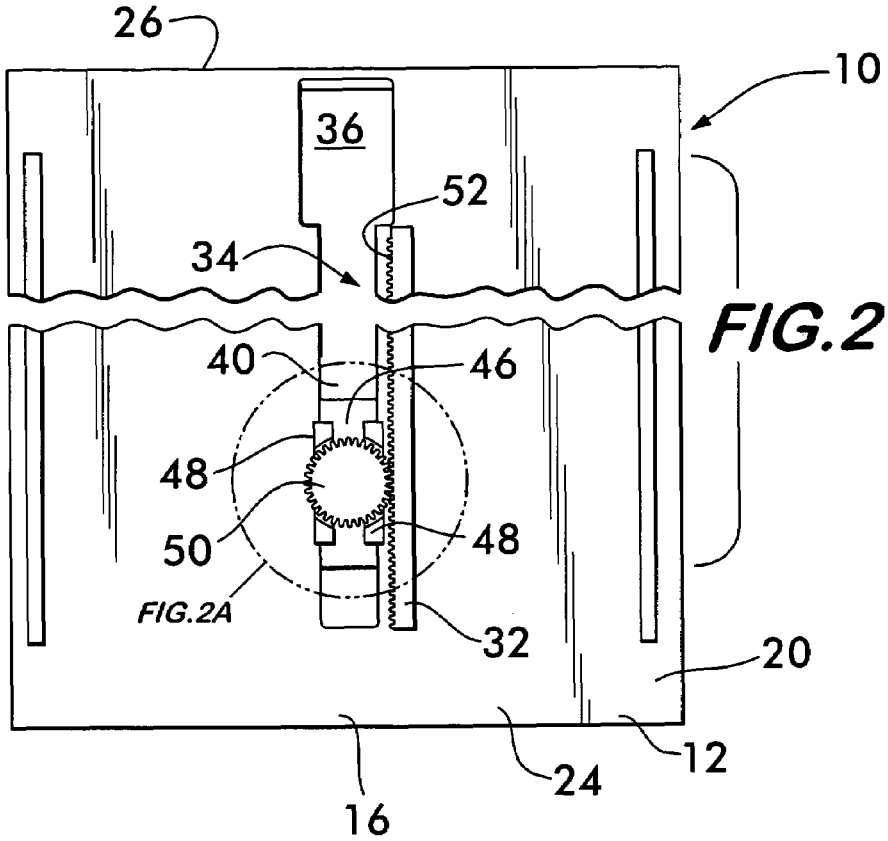
FIG. 2 is a broken bottom view of the merchandise dispenser illustrated in FIG. 1.
Figure 2A:
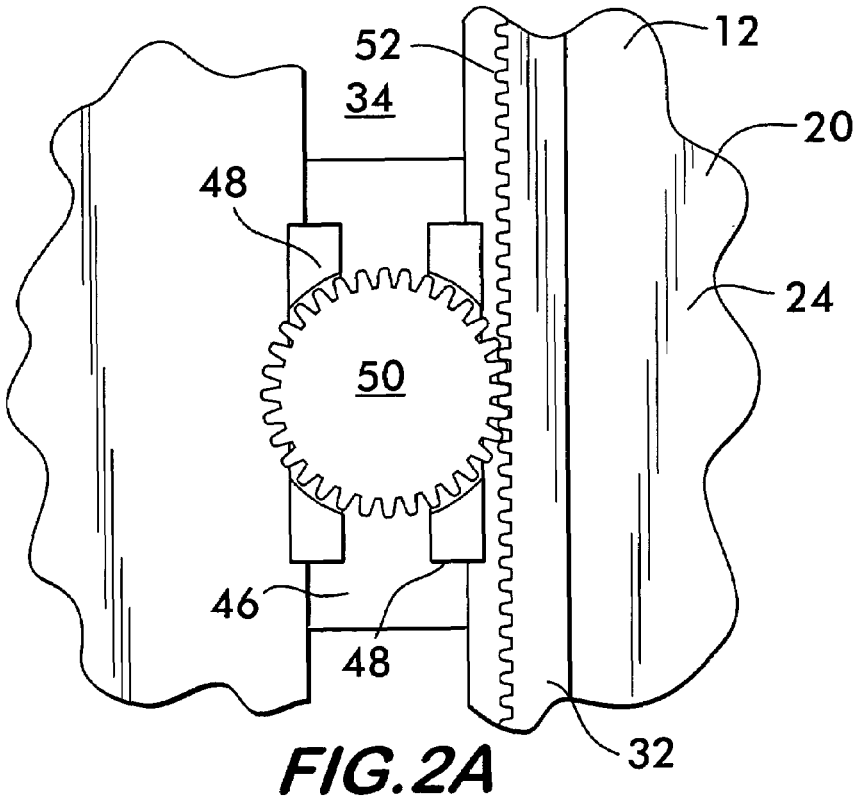
FIG. 2A is a magnified view of the drive wheel and guide track illustrated in FIG. 2.

Preferably, the pusher assembly 40 includes a drive wheel 50 or the like for engaging the guide track 32 on the base unit 12. In the illustrated embodiment, the drive wheel 50 depends from the housing 46 to a position beneath the base panel 20. As best illustrated in FIGS. 2 and 2A, the drive wheel 50 can be a gear-toothed wheel and the guide track 32 can have a gear toothed edge 52. Thus, rotation of the drive wheel 50 results in forward movement of the pusher assembly 40 within the slot 34 along the guide track 32 toward the dispensing end 16 of the base unit 12. Although not illustrated, alternate drive wheel and guide track structures can be utilized. For instance, the guide track can be provided as a belt or the like in frictional engagement with a non-gear-toothed drive wheel.

Figure 5:
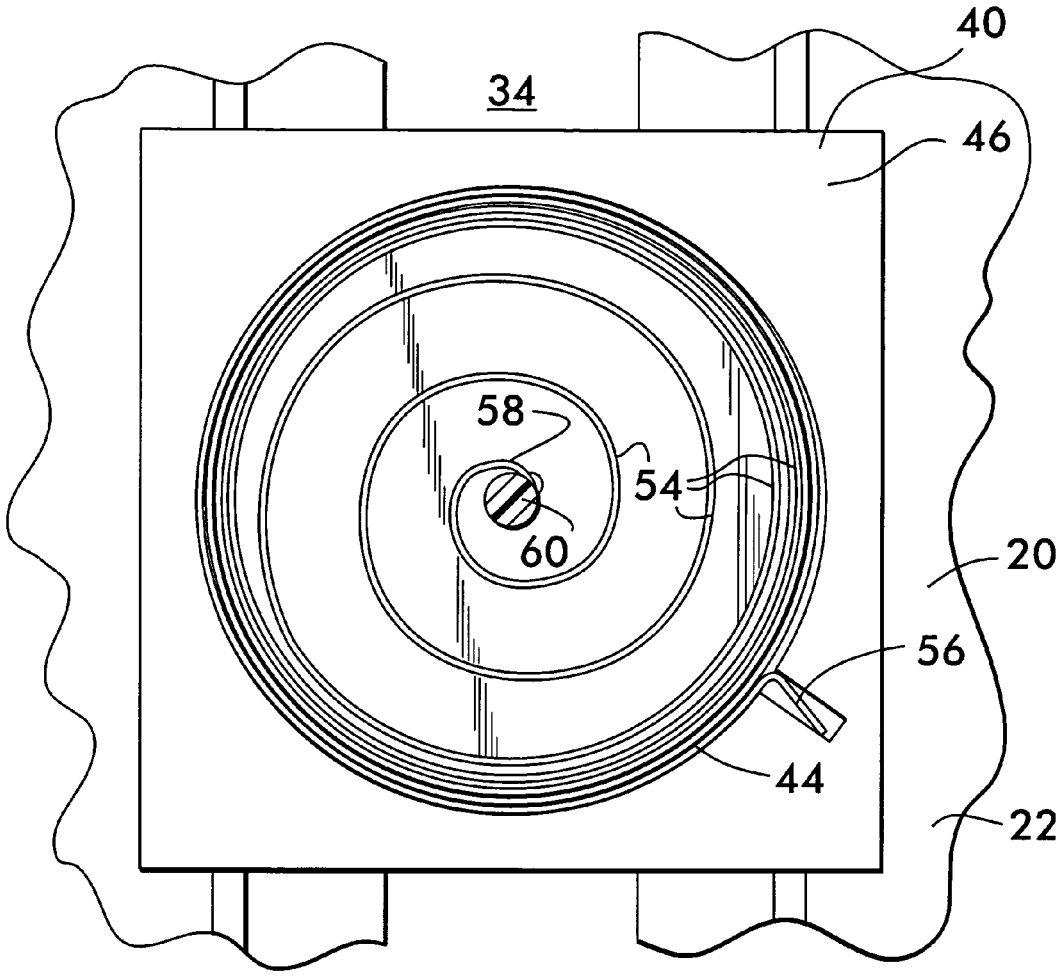
FIG. 5 is a cross-sectional view of the pusher assembly illustrated in FIG. 3 along line 5-5.

As best illustrated in FIGS. 3-5, the spring 44 can be a spiral spring having multiple windings 54 extending within a common plane. The outer end 56 of the spring 44 can be secured within the housing 46 such that it is prevented from movement relative to the housing 46. See FIG. 5. The inner end 58 of the spring 44 can be secured to an arbor 60 which interconnects to the drive wheel 50 at one end thereof and an adjustment control knob 62 at an opposite end thereof. The spiral spring 44 exerts a force, for instance as viewed in FIG. 5, in a counterclockwise direction about the arbor 60. Thus, when an item of merchandise is removed form the dispenser, the spring 44 unwinds and rotates the arbor 60 until the forward most item of merchandise confronts the wall at the dispensing end 16 of the dispenser 10.

The spiral spring 44 can be a flat metal self-coiling spring such as a steel variable force spring or a steel power spring. The spring 44 can also be a flat strip of metal or plastic which is placed in a coiled condition. The pushing force provided by the spring 44 gradually reduces as the pusher 42 approaches the front end 16 of the base unit 12 and as the spring 44 transitions from being retracted in a relatively tightly-coiled condition to a relatively loosely-coiled condition. This provides the advantage that the spring 44 exerts a maximum force when the dispenser 10 is fully loaded with a row of articles 14 and exerts a progressively reduced amount of force as the leading articles of the row are removed.

Preferably, the amount of pushing force exerted by the pusher assembly 40 is adjustable. This enables a single sized spring 44 to be used with different types of merchandise articles within a range of sizes, shapes, weights and/or surface textures that may require different amounts of force to be properly advanced within the dispenser. Obviously, heavier articles and articles that do not readily slide across the base panel 20 due to friction require greater pushing forces than lightweight articles and articles that are capable of readily sliding across the base panel 20. In addition, the use of too strong a force with relatively delicate articles may damage the articles; whereas, the use of too weak a force may result in the failure of the articles to be properly advanced within the dispenser.

As best illustrated in FIGS. 3 and 4, control knob 62 can be used to rotate arbor 60 (clockwise as viewed in FIG. 5) to tighten the windings 54 of the spring 44 or to rotate arbor 60 (counterclockwise as viewed in FIG. 5) to loosen the windings 54 of the spring 44. Before making such an adjustment, the drive wheel 50 should be disengaged from the guide track 32. As best illustrated in FIG. 3, the drive wheel 50 is resiliently maintained in engagement with guide track 32 due to the force exerted by a spring 64 located between the housing 46 and the underside of the control knob 62. However, as best illustrated in FIG. 4, the drive wheel 50 can be disengaged from guide track 32 by pressing downwardly on control knob 62 to compress spring 64. In the disengaged condition illustrated in FIG. 4, the knob 62 can be rotated thereby permitting the desired adjustment (ie., tightening or loosening) of the coiled condition of the spiral spring 44. Thereafter, the knob 62 can be raised to re-engage the drive wheel 50 with the guide track 32. Thus, the pusher assembly 40 can be set to deliver a desired pushing force within a wide range of forces and the same pusher assembly 40 and spring 44 can be used to properly feed a row of relatively heavy articles and be reset to properly feed a row of relatively lightweight articles.

In use, the pusher assembly 40 can be pulled toward end 26 of the base unit 12 so that the dispenser 10 can be loaded with a row of articles 14. If desired, the force exerted on the articles 14 by the pusher assembly 40 can be adjusted as discussed above. If the pushing force is determined to be too weak for a particular row of articles, the tension of the spring 44 can be increased by tightening the windings 54. Alternatively, if the pushing force is determined to be too strong for a particular row of articles, the tension of the spring 44 can be reduced by loosening the windings 54.

The base unit and other parts of the dispenser 10 can be made substantially of plastic or other non-metallic materials. The spring 44 carried by the pusher assembly 40 can be made of steel or the like since the entire spring 44 is located behind the row of articles 14 and since no part of the metal spring 44 extends in front of any articles 14. Thus, the pusher assembly 40 and dispenser 10 according to the present invention eliminates any possible interference with the proper functioning of RF electronic devices used for determining inventories or the like.

Further, the pusher and dispenser according to the present invention provides a universal device for use in forward, side, top and/or up feeding various products regardless of the amount of pushing force required. The pushing force can be readily adjusted as needed, and can be accurately set to ensure proper feeding of a stacked row or column of articles to a dispensing end of the merchandise dispenser.

While a preferred pusher assembly, merchandise dispenser and method have been described in detail, various modifications, alterations, and changes may be made without departing from the spirit and scope of the present invention as defined in the appended claims.

The invention claimed is:

1. A merchandise dispenser, comprising:

a base unit having a front dispensing end and an opposite end;

a pusher assembly movable along a path of travel between said front dispensing and opposite ends of said base unit, said pusher assembly including a spring for resiliently urging said pusher assembly toward said front dispensing end of said base, said entire spring being carried on said pusher assembly for movement therewith along said path of travel; and a guide track engageable with said pusher assembly and defining said path of travel on said base unit;

said pusher assembly including a drive wheel engageable with said guide track, said spring being a spiral spring having multiple coplanar windings, and, when said spring uncoils, said drive wheel rotates and causes said pusher assembly to move in a direction toward said dispensing end of said base unit.

2. A merchandise dispenser according to claim 1, wherein said drive wheel is a gear-toothed wheel and said guide track has a gear-toothed edge whereby rotation of said drive wheel results in movement of said pusher assembly along said guide track.

3. A merchandise dispenser according to claim 1, wherein a drive force exerted by said spring is adjustable by tightening or loosening said windings.

4. A merchandise dispenser according to claim 3, wherein said pusher assembly includes a control knob for tightening and loosening said windings of said spiral spring.

5. A merchandise dispenser according to claim 4, wherein said pusher assembly includes a spring mechanism for resiliently urging said drive wheel into engagement with said guide track, and wherein said control knob can be used to disengage said drive wheel from said guide track during adjustment of said drive force.

6. A merchandise dispenser according to claim 1, wherein said base unit has a merchandise support surface and an underside, wherein said pusher assembly includes a pusher projecting from said merchandise support surface.

7. A merchandise dispenser according to claim 6, wherein said base unit has an elongate slot and said guide track extends on an underside of said base unit along a length of said slot.

8. A merchandise dispenser according to claim 7, wherein said pusher assembly extends through said slot so that said drive wheel is located adjacent an underside of said base unit in engagement with said guide track.

9. A merchandise dispenser according to claim 6, wherein a plane extending through said windings of said spiral spring extends parallel to said merchandise support surface.

10. A merchandise dispenser according to claim 6, wherein said base unit includes at least one upstanding sidewall that extends parallel to said path of travel at a spaced distance therefrom, and wherein said spaced distance is adjustable.

11. A merchandise dispenser according to claim 1, wherein said spring is selected from the group consisting of a self-coiling spring, a variable force spring, a power spring, and a strip of metal or plastic positioned in a spiral.

12. A merchandise dispenser according to claim 1, further comprising a spring housing connected to said pusher assembly for movement therewith, said spring housing containing said entire spring.

13. A merchandise dispenser according to claim 12, wherein said drive wheel is connected to an arbor which is connected to an inner end of said spiral spring so that, when said spiral spring uncoils, said arbor rotates.

14. A merchandise dispenser according to claim 13, further comprising a control mechanism for adjusting the force exerted by said spring, said control mechanism including a rotatable knob extending from said spring housing and connected to an end of said arbor opposite said drive wheel.

15. A merchandise dispenser according to claim 1, wherein said drive wheel is connected to an arbor which is connected to an inner end of said spiral spring so that, when said spiral spring uncoils, said arbor rotates.

16. A merchandise dispenser according to claim 1, further comprising a control mechanism for adjusting the force exerted by said spring.

17. A merchandise dispenser according to claim 1, wherein said drive wheel is a gear-toothed wheel.

18. A merchandise dispenser according to claim 1, wherein said base unit includes at least one upstanding sidewall that extends parallel to said path of travel at a spaced distance therefrom, and wherein said spaced distance is adjustable.

* * * * *